US006024331A

United States Patent [19]

Bischoff et al.

[11] Patent Number: 6,024,331

[45] Date of Patent: Feb. 15, 2000

[54] ROD-MOUNTED HOLDER BRACKET FOR HAND SHOWER

[75] Inventors: Bernd Bischoff, Hemer; Bruno Heimann, Fröndenberg, both of Germany

[73] Assignee: Friedrich Grohe AG, Hemer, Germany

[21] Appl. No.: 08/986,958

[22] Filed: Dec. 8, 1997

[30] Foreign Application Priority Data

Feb. 12, 1997 [DE] Germany ..... 197 05 285

[51] Int. Cl.[7] ..... A47K 3/22

[52] U.S. Cl. ..... 248/229.1; 4/615; 248/230.1; 248/292.12; 248/314

[58] Field of Search ..... 248/229.1, 230.1, 248/231.85, 291.1, 292.12, 75, 314; 4/615

[56] References Cited

U.S. PATENT DOCUMENTS

| | | | |
|---|---|---|---|
| 1,546,739 | 7/1925 | LeLande | 248/292.12 |
| 2,931,613 | 4/1960 | Grohe | 248/230.1 |
| 3,167,292 | 1/1965 | Meyerowitz | 248/230.1 |
| 4,174,822 | 11/1979 | Larsson | 248/229.1 X |
| 4,719,654 | 1/1988 | Blessing | 4/615 X |
| 4,964,573 | 10/1990 | Lipski | 4/615 X |
| 5,070,552 | 12/1991 | Gentry et al. | 4/615 |
| 5,265,833 | 11/1993 | Heimann et al. | 248/291.1 X |
| 5,277,391 | 1/1994 | Haug et al. | 4/615 X |
| 5,481,765 | 1/1996 | Wang | 4/615 X |
| 5,632,049 | 5/1997 | Chen | 4/615 X |

FOREIGN PATENT DOCUMENTS

| | | |
|---|---|---|
| 0526775 | 2/1993 | European Pat. Off. . |
| 0607877 | 7/1994 | European Pat. Off. . |
| 23 42 613 | 2/1975 | Germany . |
| 75 21 122 | 2/1976 | Germany . |
| 91 10 622 | 11/1991 | Germany . |

*Primary Examiner*—Derek J. Berger
*Attorney, Agent, or Firm*—Herbert Dubno; Andrew Wilford

[57] ABSTRACT

A holder bracket for securing a hand shower to a stationary rod centered on a rod axis has a support body having structure forming a forwardly open seat for the hand shower and formed with a throughgoing laterally closed passage through which the rod passes and, to one side of the axis, with at least one rib bearing radially on the rod. A retaining element mounted on the support body to the other side of the axis bears radially on the rod opposite to the rib. A compressible member engaged between the retaining element and the body presses the element radially against the body and thereby compresses the rod between the element and the rib.

18 Claims, 9 Drawing Sheets

ROD-MOUNTED HOLDER BRACKET FOR HAND SHOWER

FIELD OF THE INVENTION

The present invention relates to a hand shower. More particularly this invention concerns a holder bracket that is movable on a wall-mounted rod and that has a seat for holding a hand shower.

BACKGROUND OF THE INVENTION

It is standard to mount a hand shower on a vertical wall-mounted rod for stationary use of the hand shower. Normally a releasable holder bracket or clamp is provided for moving the hand shower up and down on the rod to adjust its vertical position.

The holder bracket can comprise as described in German patent 2,342,613 of U. Koch a support body that surrounds the rod and that is provided internally with a pair of tapered seats on which ride split rings that are braced against a spring such that they normally contract radially and tightly engage the rod. To move the rod, at least one of the rings must be pushed in against the spring force to spread it and allow it to release the rod. In this arrangement the support body has a pin on which the hand shower is fitted.

In German utility model 75 21 122 assigned to Hans Grohe KG a wedge in the support body rides on a surface that extends at an angle to the rod and a spring urges the wedge axially in a direction camming the wedge against the rod. To move the holder bracket, the wedge is pressed oppositely, thereby freeing the support body from the rod.

A simpler system that does not require special actuation of the bracket to allow it to be shifted axially on the rod is described in German utility model 18 39 393 of F. Florenz. This system has an elastomeric liner in the bracket that engages the rod with some friction so as to resist sliding of the bracket along the rod unless pushed with quite some force.

Commonly owned U.S. Pat. No. 5,265,833 describes a mounting bracket for a hand shower that has a support adapted to be fixed to the wall-mount rod, a holder formed with a forked seat shaped to receive the stem of the hand-shower, and interengaging formations on the holder and support for pivoting of the holder on the support about a normally horizontal axis while retaining the holder and support against relative axial movement. An array of radially extending ridges formed on the support, surrounding the axis, and projecting toward the holder engage with complementary ridges formed on a flange of a retaining element rotationally coupled to the holder. A locking bolt axially fixed in the support axially presses the retaining-element ridges against the support ridges so that the holder can be pivoted about the axis on the support with elastic deformation of the flange.

All these systems function well at least when new. When worn or when soap gets into them they tend to loosen and allow the shower to slip on the rod. The manually actuated systems are clumsy to use and also often loosen as they wear.

OBJECT OF THE INVENTION

It is therefore an object of the present invention to provide an improved holder bracket for a hand shower.

Another object is the provision of such an improved holder bracket for a hand shower which overcomes the above-given disadvantages, that is which is easy to use and which can be adjusted to avoid loosening with time.

SUMMARY OF THE INVENTION

A holder bracket for securing a hand shower to a stationary rod centered on a rod axis has according to the invention a support body having structure forming a forwardly open seat for the hand shower and formed with a throughgoing laterally closed passage through which the rod passes and, to one side of the axis, with at least one rib bearing radially on the rod. A retaining element mounted on the support body to the other side of the axis bears radially on the rod opposite to the rib. A compressible member engaged between the retaining element and the body presses the element radially against the body and thereby compresses the rod between the element and the rib.

Thus with this system the rod is gripped between the rib(s) and the retaining element so that the support body can be moved along the rod but will stay at any place when left there. Such gripping between at least two defined points ensures that the holding force will remain the same under most conditions.

The body according to the invention is formed in the passage with two such ribs extending axially and spaced angularly from each other about the rod axis by between 45° and 120°, preferably 60°. Each rib projects radially inward between 0.1 mm and 1.5 mm. Normally the rod is cylindrical and the rib has a complementarily part-cylindrical outer surface bearing against the rod. To this end the retaining element has a part-spherical surface bearing directly on the rod. More specifically the retaining element includes a body threaded into the support body and formed with a central radially extending hole. The retaining element has a pin radially slidable in the hole and the compressible member is engaged between the retaining-element body and the retaining element. This compressible member is an elastomeric ring surrounding the pin. For ease of assembly the pin has radially outwardly projecting and inwardly deflectable ends that project through and radially past the hole of the retaining-element body.

The structure of the support body according to the invention is a ball formed with the seat and pivotal on the support body about a ball axis lying in a plane perpendicular to the rod axis. The support body has a pair of arms defining a mouth holding the ball and each formed with a throughgoing hole on the ball axis. The ball is formed with a pair of pins lying on the ball axis and engaged in the arm holes and with a plurality of grooves extending parallel to and offset angularly about the ball axis. The holder bracket further has according to the invention a latch element mounted on the support body and engageable in the grooves and a spring braced between the latch element and the support body and urging the latch element toward the ball and into the grooves. Each ball pin has an outer end formed with a lateral projection that extends radially of the ball axis past the respective arm hole when engaged therein. The latch stem has a noncylindrical stem projecting radially of the ball axis and the body is formed with a noncylindrical guide complementarily slidable receiving the stem and directed radially of the ball axis toward the ball so that the latch element cannot pivot about the stem. Normally the latch element has a tooth engageable in the grooves. The grooves are all substantially identical and the tooth is complementary to each of the grooves. Alternately the tooth is a roller.

The hand-shower holder bracket in accordance with the invention is provided with a cover surrounding the support body. This cover has a front part formed with a cutout corresponding to the seat and a throughgoing hole corresponding to the rod passage and a rear part fitted with the front part. The support body and front part are formed with interengaging guide formations. The support body is formed with laterally inwardly deflectable holding tabs, and the front part is formed with holes in which the tabs engage. The rear part is formed with a pair of oppositely inwardly projecting tabs also engaged in the holes of the front part. The retaining element is threaded in the support body and the rear part has a throughgoing hole through which the retaining element is accessible.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
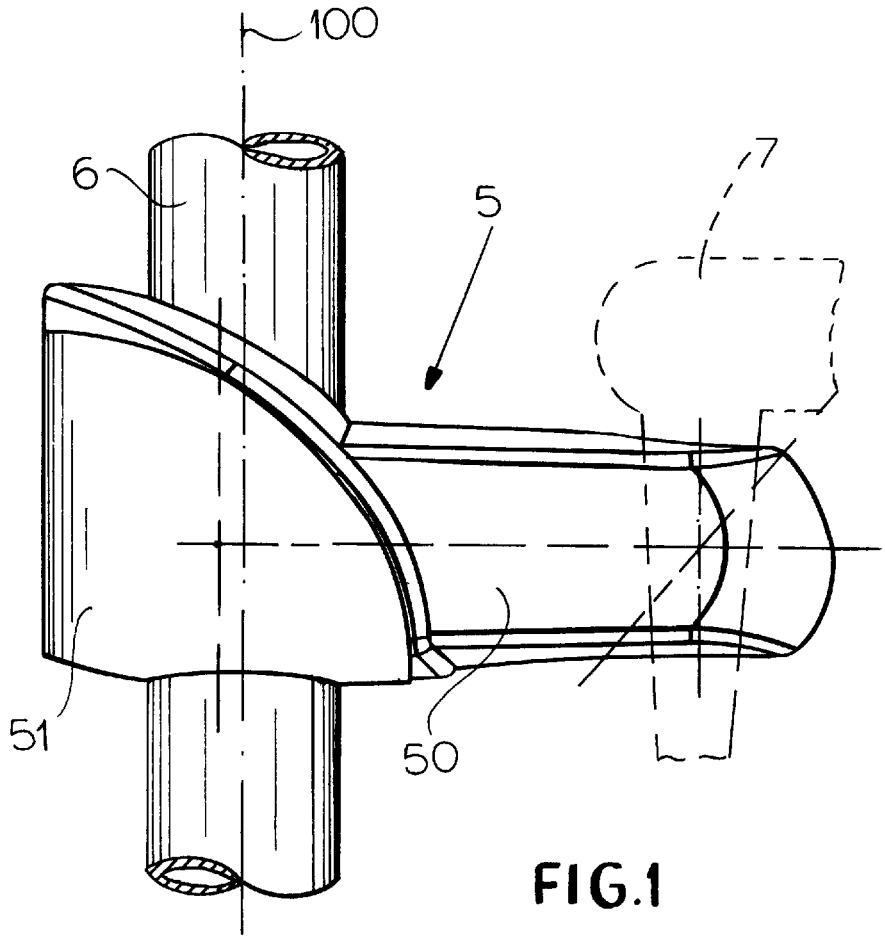
FIGS. 1, 2, and 3 are side, front, and top views of the hand-shower holder bracket according to the invention.
Figure 3:
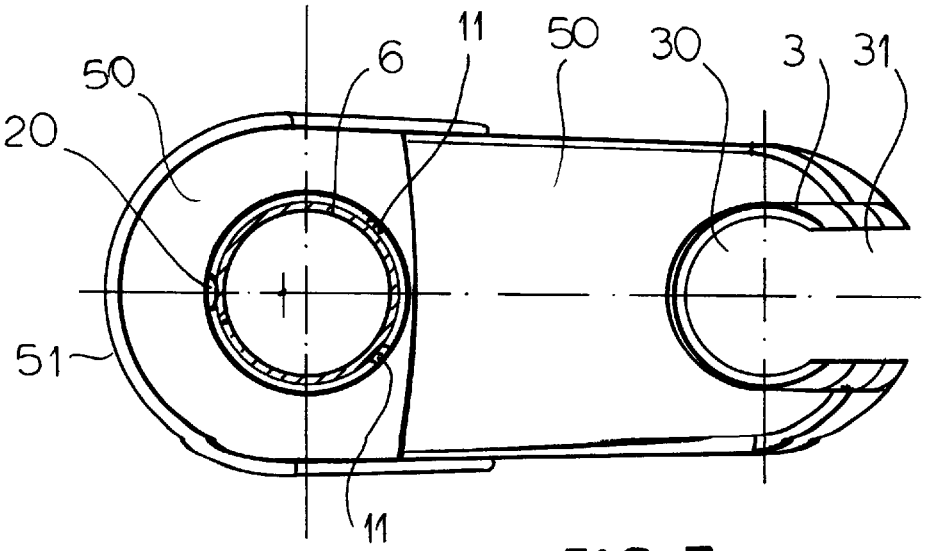
Figure 2:
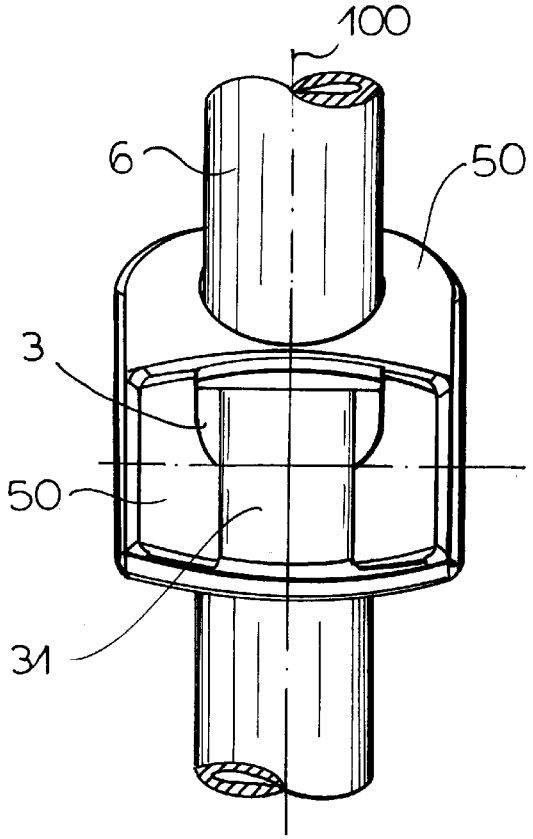
Figure 4:
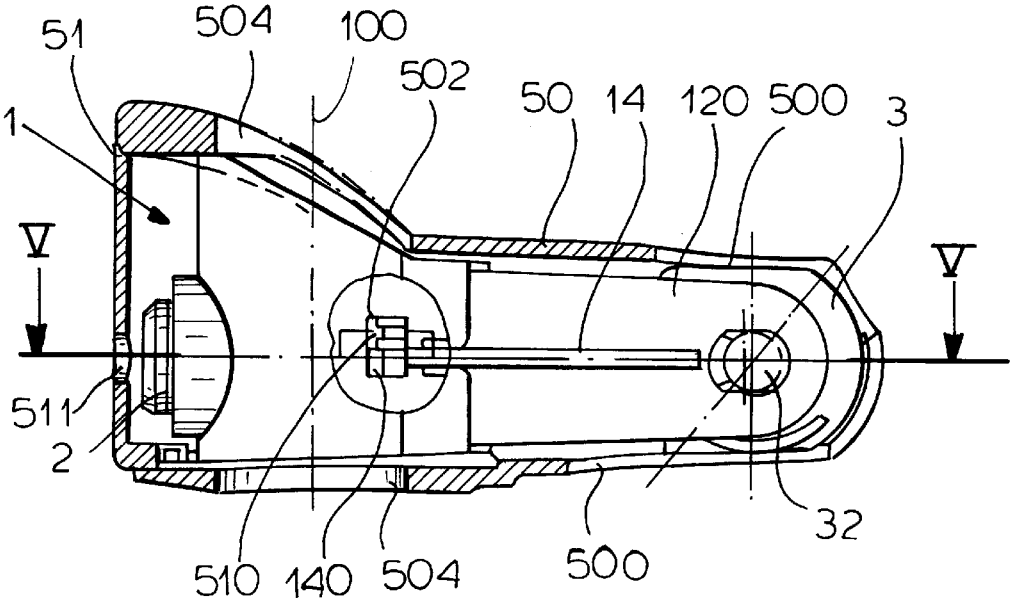
FIG. 4 is a vertical section through the bracket.

As seen in FIGS. 1 through 6 a hand-shower mounting bracket basically comprises a support body 1, a retaining element 2 threaded into the body 1, a ball seat 3 pivotally mounted on the body 1, a latch element 4 engaged between the body 1 and the element 3, and a decor cover 5 surrounding the parts 1 through 4. These elements 1–5 are all mounted on a rod 6 formed as a cylindrical tube centered on a vertical axis 100. A hand shower shown partially in dashed lines at 7 is carried by this mount.

Figure 7:
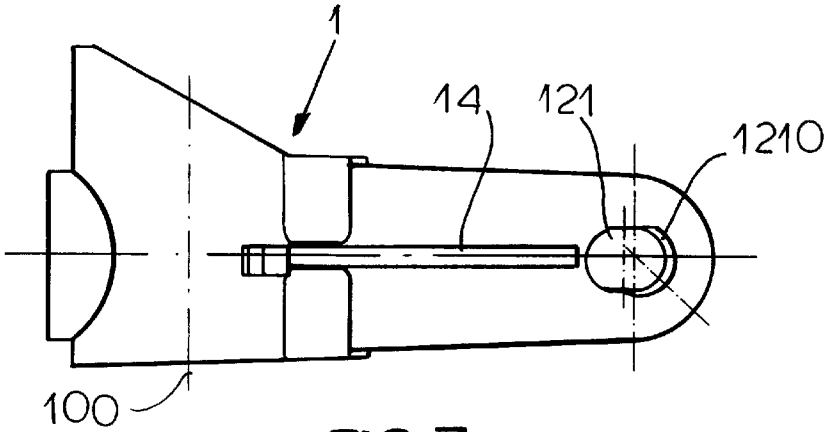
FIGS. 7, 8, and 9 are side, front, and top views of the support body of the bracket in accordance with the invention.
Figure 9:
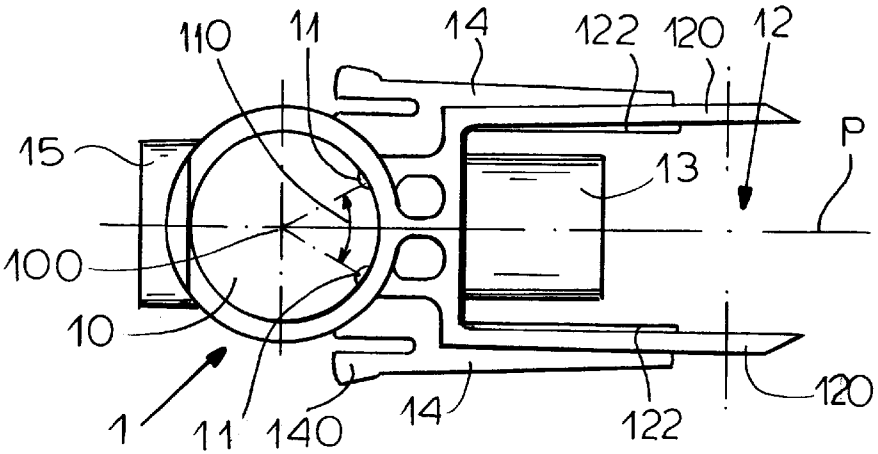
Figure 8:
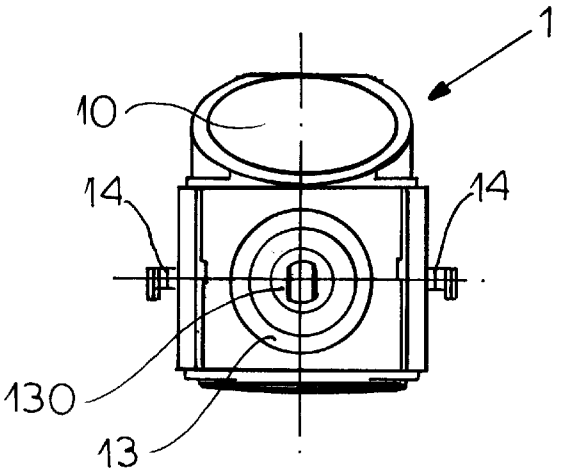

The support body 1 has as shown in FIGS. 7 through 9 a pair of arms 120 defining a mouth 12 in which the ball 3 is received and which are formed with transverse ribs 122 that coact with the ball 3 as described below. In addition the arms 120 are formed with outwardly projecting guide ribs 14 terminating at their rear ends in laterally deflectable tabs 140 that coact with the decor cover 5 as also described below. Each arm 120 is formed with a throughgoing hole 121 that is cut away at 1210 at its front end.

At its rear end the support 1 is formed with a cylindrical and vertically throughgoing passage 10 centered on the axis 100 and adapted to receive the rod 6. Inside this passage 10 the body 1 is formed with a pair of axially extending and radially inwardly projecting ribs 11 axially flanking a symmetry plane P of the support 1, separated by an angle 110 here of about 60°, and having a radial inward projection of between 0.1 mm and 1.5 mm, here 0.5 mm. These two ribs 11 therefore engage the rod 6 oppositely to the retaining element 2 as described below. Instead of two angularly spaced ribs 11, three or more such ribs, all forward of a plane perpendicular to the plane P and including the axis 100, could be used, or one wide rib bisected by the plane P.

In addition the support 1 is formed with a rearwardly open threaded socket 15 and with a forwardly open cylindrical guide 13 inside of which is another guide 130 with a cylindrical outer surface but a noncylindrical inner surface.

Figure 11:
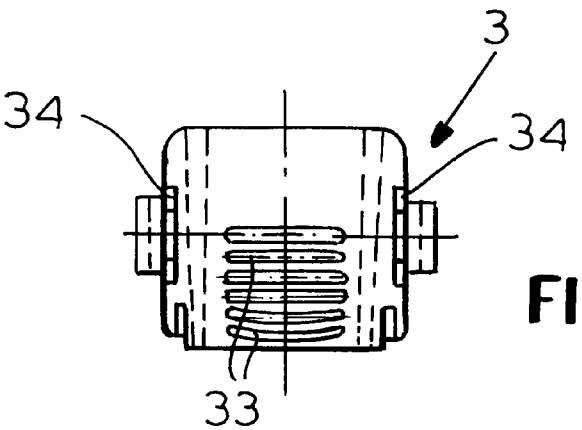
FIGS. 10, 11, and 12 are side, back, and top views of the seat ball of the bracket.
Figure 10:
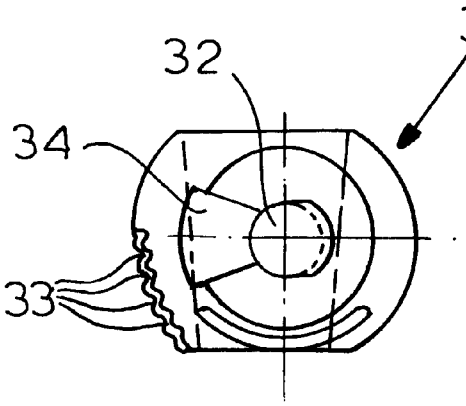
Figure 12:
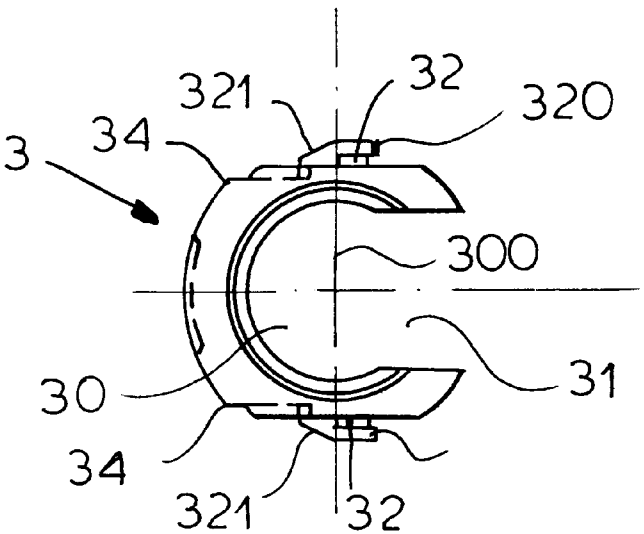

The ball 3 shown in FIGS. 10 through 12 is formed with a central frustoconically tapered seat 30 open at one side 31 and shaped to receive the stem of the standard hand shower 7. This ball 3 has two pivot pins 32 with outer ends that project laterally at 320 and back sides beveled at 321. In addition each flat side of the ball 3 is formed with a V-shaped cutout 34. When installed the pivots 32 project out through the holes 121 in the arms 120 of the support body 1 and the overhanging ends 320 engage in the cutouts 1210 to prevent disengagement so long as the ball 3 is urged forward in the mouth 12 (to the right in FIGS. 7 and 9). The ribs 122 engage in the cutouts 34 and allow around 40° of tipping of the ball 3 in the seat 12 about an axis 300 perpendicular to the plane P and extending through the pivot pins 32. A rear side of the ball 3 is formed with a series of ridges 33 extending parallel to the axis 300.

Figure 14:
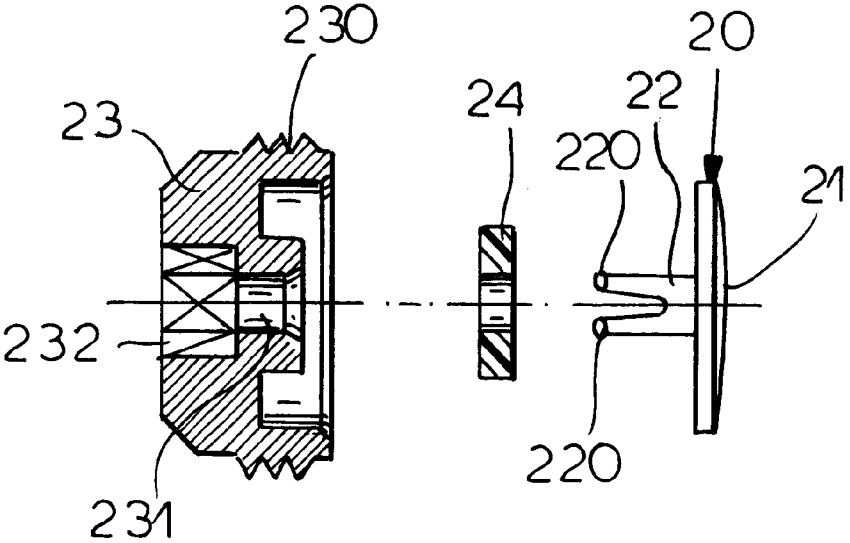
FIG. 14 is an exploded sectional view of the element of FIG. 13.
Figure 13:
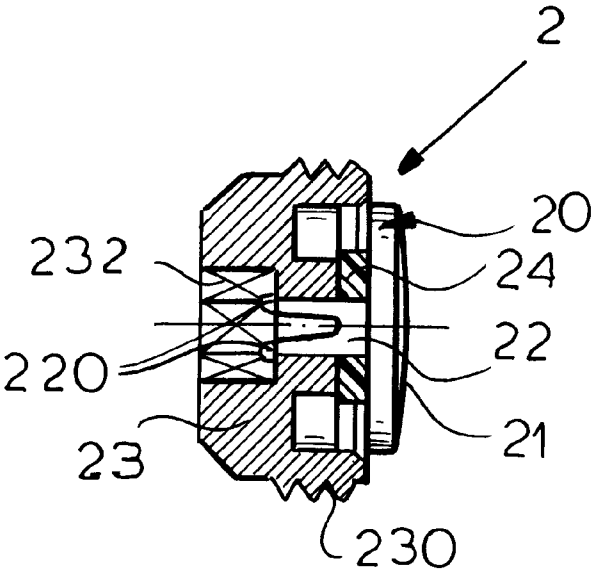
FIG. 13 is a section through the retaining element of the bracket.

FIGS. 13 and 14 show the retaining element 2 which has an external screwthread 230 for mounting in the internally threaded collar 15 of the body 1. It has a basically cylindrical body 23 formed with a central throughgoing hole 231 widened and faceted at its rear end 232 to receive a tool, here a hex wrench. A pressure element 20 has a stem 22 slidable in the bore 231 and formed with barbs 220 that prevent it from being pushed forward out of the body 23. The element 20 has a forwardly convex head 21 that engages the rod 6 on the plane P oppositely to the ribs 11 and a compressible elastomeric ring 24 is received between a back surface of the head 21 and a front surface of the body 23.

Figure 5:
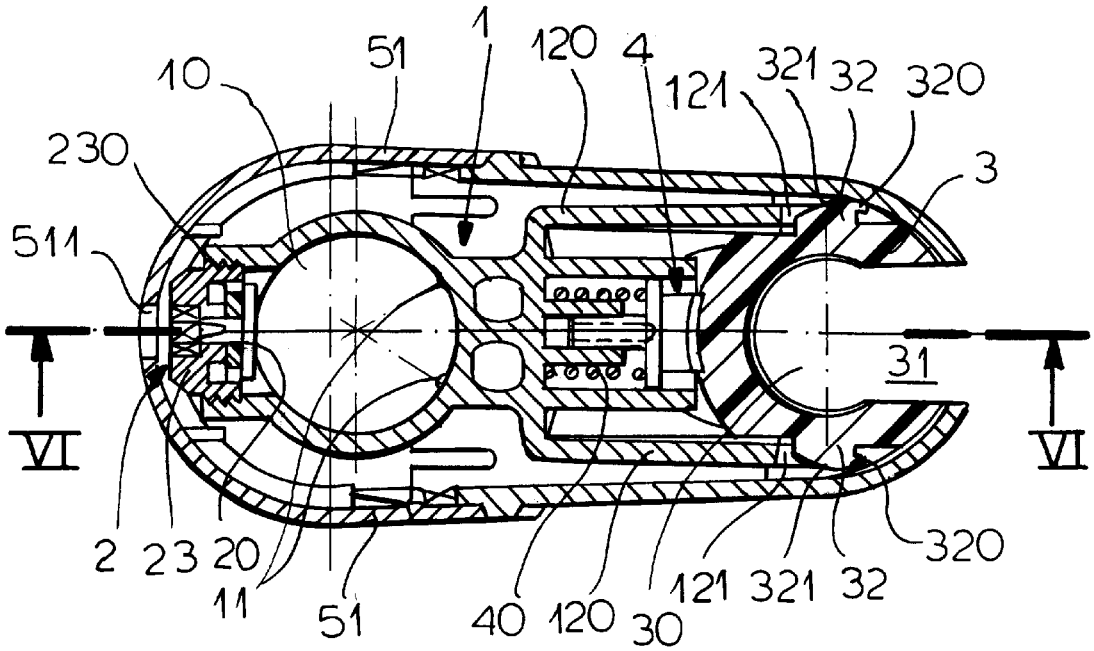
FIG. 5 is a horizontal section taken along line V—V of FIG. 4.
Figure 6:
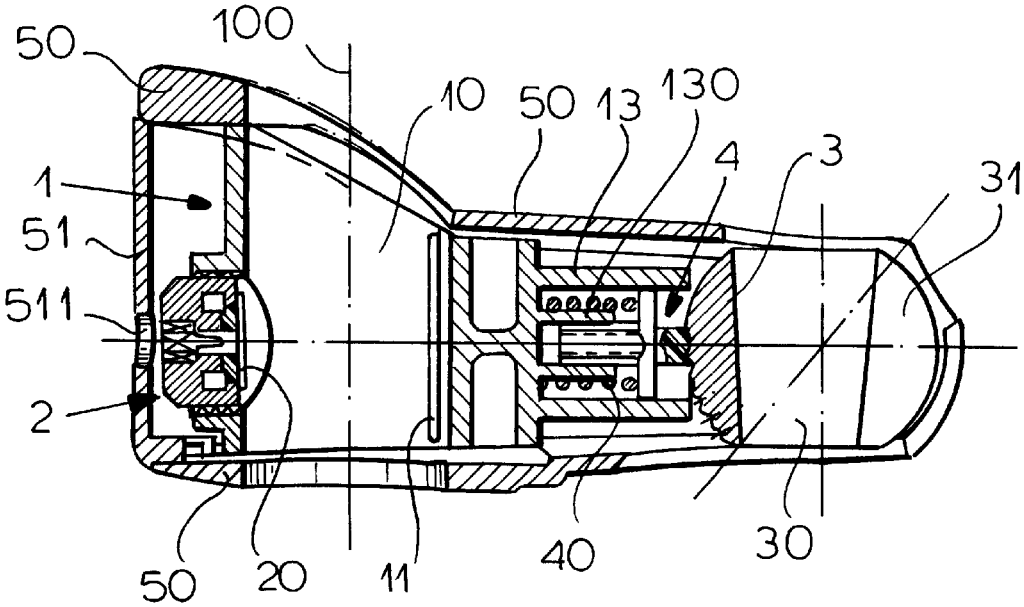
FIG. 6 is a vertical section taken along line VI—VI of FIG. 5.
Figure 15:
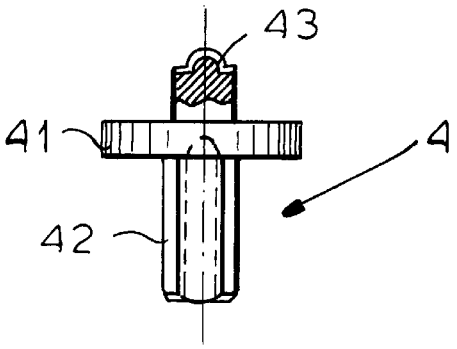
FIG. 15 is a partly sectional end view of the latch element of the bracket.
Figure 16:
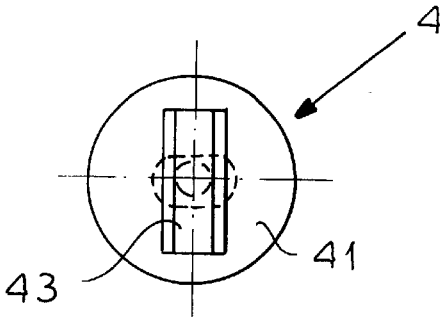
FIGS. 16 and 17 are front and side views of the element of FIG. 15.
Figure 17:
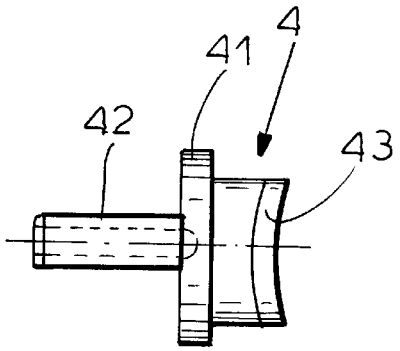

The latch element 4 shown in FIGS. 15 through 17 has a stem 42 of noncylindrical shape that fits complementarily in the guide 130 and a head 41 from which a tooth or ridge 43 projects forwardly. This tooth 43 is forwardly concave and shaped to engage in the grooves 33 of the ball 3 and as shown in FIG. 5 a spring 40 is engaged around the guide 130 and braced backward against the body 1 and forward against the head 41 to urge this tooth 43 against the ball 3. Thus the ball 3 can rock about the axis 300 but will be retained in several angularly offset position by interengagement of the tooth 43 and grooves 33.

Figure 18:
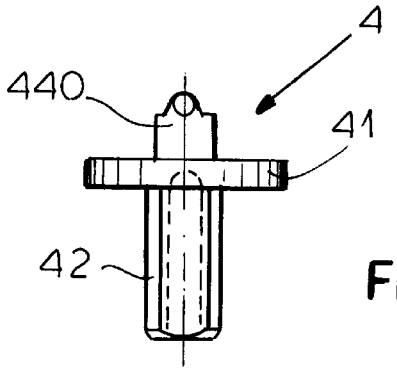
FIGS. 18, 19, and 20 are end, front, and side views of another latch element according to the invention.
Figure 19:
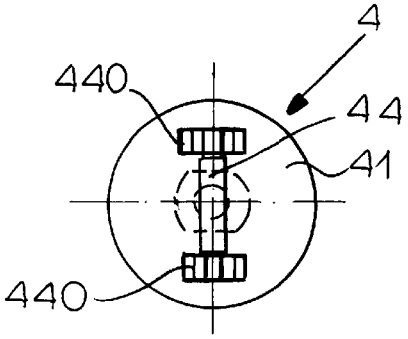
Figure 20:
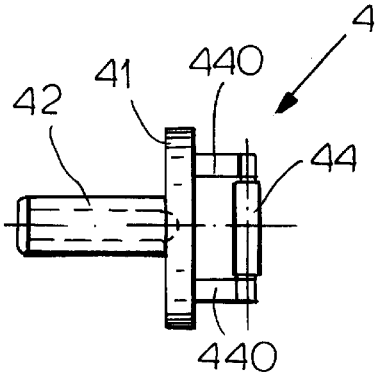
Figure 21:
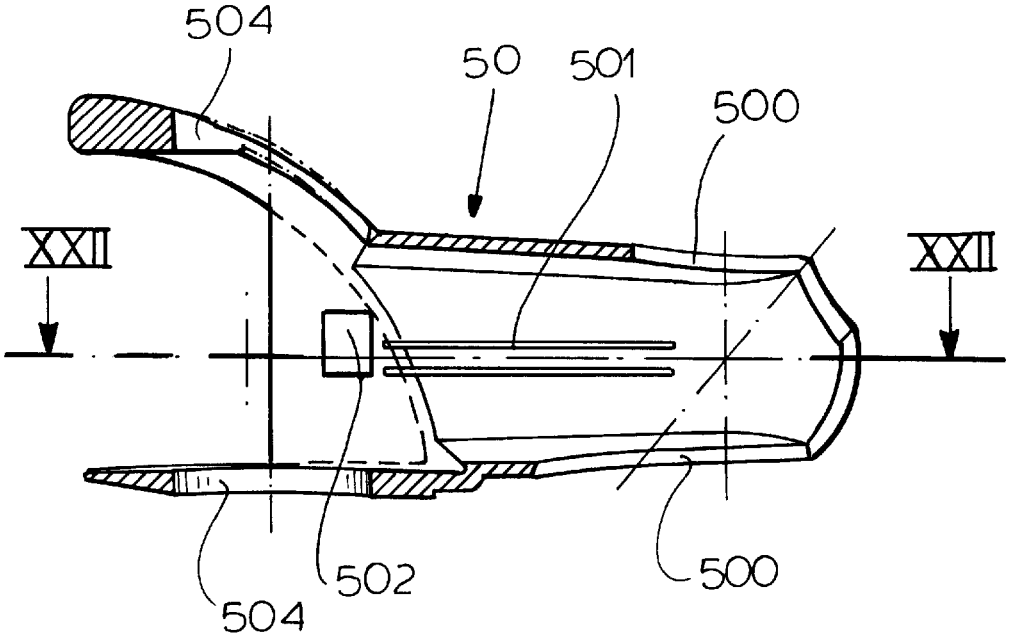
FIG. 21 is a vertical section through the decor cover of the bracket.
Figure 22:
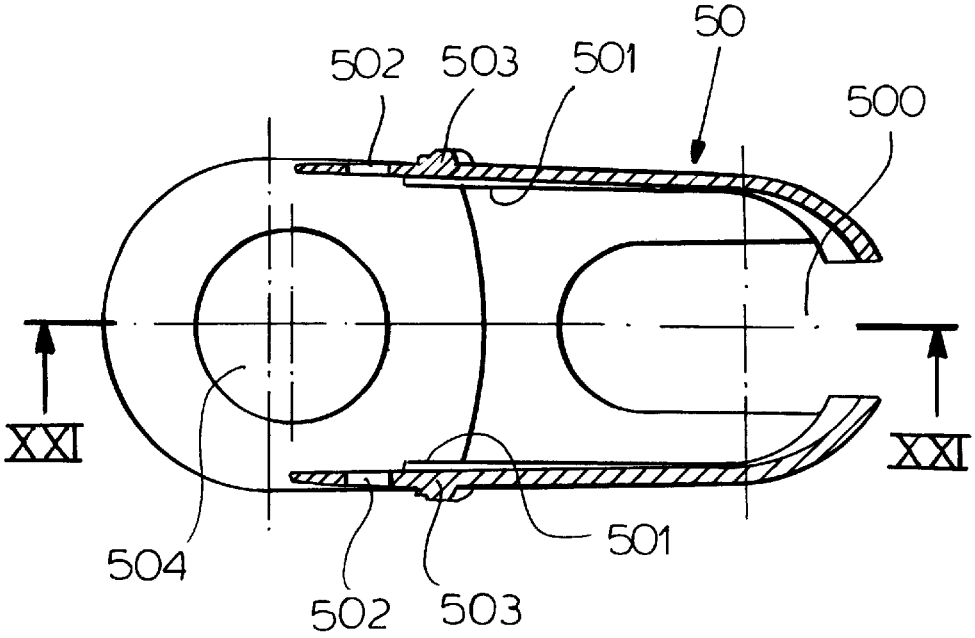
FIG. 22 is a horizontal section taken along line XXII—XXII of FIG. 21, line XXI—XXI of FIG. 22 indicating the section plane of FIG. 21
Figure 24:
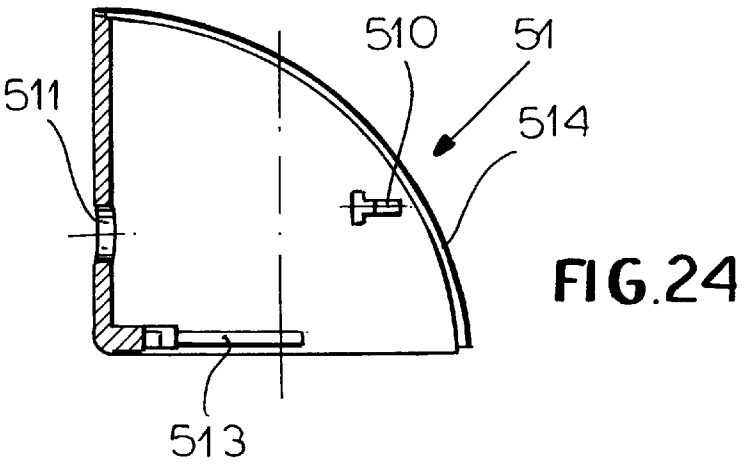
FIG. 24 is a section taken along line XXIV—XXIV of FIG. 23.
Figure 23:
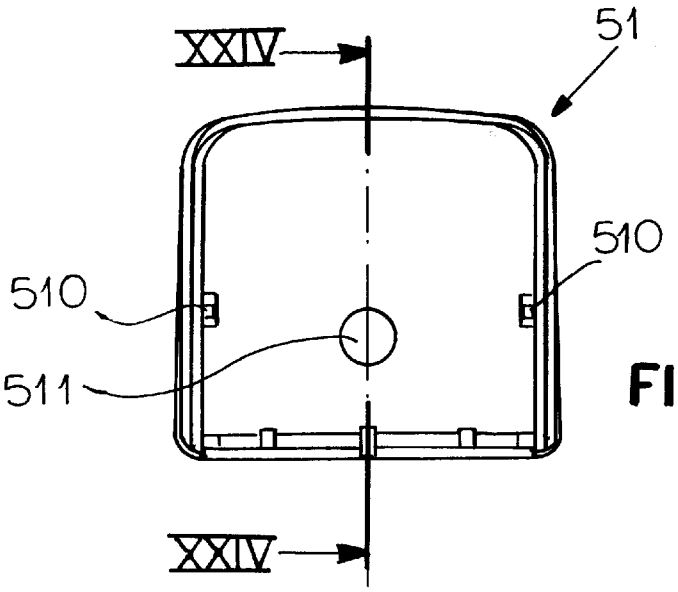
FIG. 23 is an end view of the rear part of the decor cover.
Figure 25:
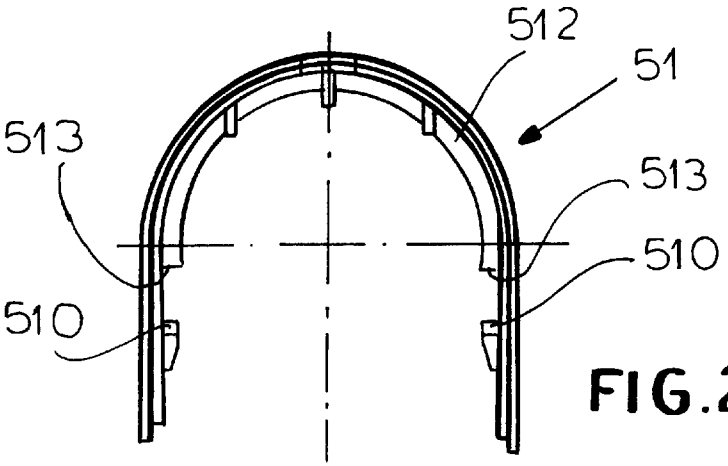
FIG. 25 is a top view of the rear part of FIGS. 23 and 24.

FIGS. 18 through 20 show how instead of a tooth 43 the device can have a pair of arms 440 carrying a roller 44 that fits in the grooves 33. This system has a fairly long service life and operates very smoothly.

The decor cover 5 shown in FIGS. 21 through 25 is formed of a front part 50 and a back part 51 both formed by injection molding from a durable and flexible plastic. The front part 50 is formed at its narrow front end with a vertically throughgoing cutout or notch 500 that aligns with the hole 30 of the ball 3 to pass the stem and supply hose of the hand shower 7. At its rear end it has a cylindrical throughgoing hole 504 to accommodate the rod 6. Internally it has two pairs of ridges forming guides 501 and on each side a throughgoing retaining hole 502. Externally it is formed forward of the holes 502 with a rearwardly directed decorative ridge 503.

The rear part 51 is formed with a pair of inwardly projecting lugs 510 adapted to snap into the holes 502 with front edges 514 of the part 51 fitting complementarily with the ridges 503. Centrally the part 51 is formed with a hole 511 that in the assembled system is aligned with the tool recess 232 of the element 2, and a stiffening rib 512 with abutment ends 513 projects radially inward from adjacent its lower edge.

This structure is assembled as follows:

First the element 2 is threaded into the collar 15 of the support body 1 and then the latch element 4 and its spring 40 are fitted into the guide 13. Then the ball 3 is pushed along the plane P back into the mouth 12 with the bevels 321 first camming the arms 120 apart so that when the pivots 32 align with the holes 121 these arms 120 will snap back in. The forward or outward push of the spring 40 will keep the end projections 320 extending forward past the fronts of the holes 121 to prevent any subsequent disengagement. Once thus installed the ball 3 will be able to tip about its axis 300 through 40° as described above, with ratcheting of the tooth 43 or roller 44 in the grooves 33 and travel limited by the interfit of the ribs 122 and grooves 34.

The front part 50 is then pushed back over the body 1 with its guides 501 fitting with the ribs 14 until the tabs 140 of the body 1 come level with the holes 502 and fit into them, inhibiting reverse outward movement of the part 50. Then the rear part 51 is pushed forward into position with its tabs 510 fitting into the holes 502 next to the tabs 140, similarly retaining the part 51 in position with its edge 514 smoothly engaged against the ridge 503. The abutments ends 513 of the reinforcing rib 512 come to rest on the rear edge of the front part 50. The holes 502 are thus covered so that the system presents a very neat appearance.

We claim:

1. In combination with a stationary rod centered on a rod axis, a holder bracket for securing a hand shower to the rod centered, the bracket comprising:

a support body having structure forming a forwardly open seat for the hand shower, the body being formed with a throughgoing laterally closed passage through which the rod passes and, to one side of the axis, with at least one rib bearing radially on the rod;

a retaining element threaded in the support body to the other side of the axis as the rib and bearing radially on the rod opposite to the rib;

a cover surrounding the support body and formed with a throughgoing hole through which the retaining element is accessible; and means including a compressible member engaged between the retaining element and the body for pressing the element radially against the body and thereby compressing the rod between the element and the rib.

2. The hand-shower holder bracket defined in claim 1 wherein the body is formed in the passage with two such ribs extending axially and spaced angularly from each other about the rod axis by between 45° and 120 °.

3. The hand-shower holder bracket defined in claim 1 wherein the rib projects radially inward between 0.1 mm and 1.5 mm.

4. The hand-shower holder bracket defined in claim 1 wherein the rod is cylindrical and the rib has a part-cylindrical outer surface bearing against the rod.

5. The hand-shower holder bracket defined in claim 1 wherein the retaining element has a part-spherical surface bearing directly on the rod.

6. The hand-shower holder bracket defined in claim 1 wherein the retaining element includes a body threaded into the support body and formed with a central radially extending hole, the retaining element having a pin radially slidable in the hole, the compressible member being engaged between the retaining-element body and the retaining element.

7. The hand-shower holder bracket defined in claim 6 wherein the compressible member is an elastomeric ring surrounding the pin.

8. The hand-shower holder bracket defined in claim 6 wherein the pin has radially outwardly projecting and inwardly deflectable ends that project through and radially past the hole of the retaining-element body.

9. The hand-shower holder bracket defined in claim 1 wherein the structure is a ball formed with the seat and pivotal on the support body about a ball axis lying in a plane perpendicular to the rod axis.

10. The hand-shower holder bracket defined in claim 9 wherein the support body has a pair of arms defining a mouth holding the ball and each formed with a throughgoing hole on the ball axis, the ball being formed with a pair of pins lying on the ball axis and engaged in the arm holes and with a plurality of grooves extending parallel to and offset angularly about the ball axis, the holder bracket further comprising:

a latch element mounted on the support body and engageable in the grooves; and a spring braced between the latch element and the support body and urging the latch element toward the ball and into the grooves.

11. The hand-shower holder bracket defined in claim 10 wherein each ball pin has an outer end formed with a lateral projection that extends radially of the ball axis past the respective arm hole when engaged therein.

12. The hand-shower holder bracket defined in claim 10 wherein the latch element has a noncylindrical stem projecting radially of the ball axis and the body is formed with a noncylindrical guide complementarily slidably receiving the stem and directed radially of the ball axis toward the ball, whereby the latch element cannot pivot about the stem.

13. The hand-shower holder bracket defined in claim 10 wherein the latch element has a tooth engageable in the grooves.

14. The hand-shower holder bracket defined in claim 13 wherein the grooves are all substantially identical and the tooth is complementary to each of the grooves.

15. The hand-shower holder bracket defined in claim 13 wherein the tooth is a roller.

16. The hand-shower holder bracket defined in claim 1 wherein the cover includes a front part formed with a cutout corresponding to the seat and a throughgoing hole corresponding to the rod passage, and a rear part fitted with the front part.

17. The hand-shower holder bracket defined in claim 16 wherein the support body and front part are formed with interengaging guide formations, the support body is formed with laterally inwardly deflectable holding tabs, and the front part is formed with holes in which the tabs engage.

18. The hand-shower holder bracket defined in claim 17 wherein the rear part is formed with a pair of oppositely inwardly projecting tabs also engaged in the holes of the front part.

* * * * *